US006615723B1

(12) United States Patent
Haas

(10) Patent No.: US 6,615,723 B1
(45) Date of Patent: Sep. 9, 2003

(54) DEVICE FOR POWDERING PRINTING SHEETS

(75) Inventor: Reiner Haas, Metzingen (DE)

(73) Assignee: Weitmann & Konrad GmbH & Co., Leinfelden-Echterdingen (DE)

( * ) Notice: Subject to any disclaimer, the term of this patent is extended or adjusted under 35 U.S.C. 154(b) by 0 days.

(21) Appl. No.: 09/762,181

(22) PCT Filed: Jul. 10, 1999

(86) PCT No.: PCT/EP99/04863

§ 371 (c)(1),
(2), (4) Date: Feb. 2, 2001

(87) PCT Pub. No.: WO00/09336

PCT Pub. Date: Feb. 24, 2000

(30) Foreign Application Priority Data

Aug. 10, 1998 (DE) ..... 198 36 014

(51) Int. Cl.[7] ..... B05D 1/12

(52) U.S. Cl. ..... 101/424.2; 101/484; 118/308; 118/314

(58) Field of Search ..... 101/424.2, 484; 239/8, 705, 305; 118/308, 314, 46, 629, 630, 236; 427/202, 180, 424

(56) References Cited

U.S. PATENT DOCUMENTS 4,332,198 A * 6/1982 Schmoeger ..... 101/424.2
4,867,063 A * 9/1989 Baker et al. ..... 101/424.2
5,615,830 A * 4/1997 Matsunaga et al. ..... 222/368
5,660,633 A * 8/1997 Murata et al. ..... 118/308
5,746,131 A * 5/1998 Henn et al. ..... 101/416.1
5,943,955 A * 8/1999 Niemiro et al. ..... 101/216
6,085,654 A * 7/2000 Gunschera et al. ..... 101/416.1
6,250,224 B1 * 6/2001 Hofmann et al. ..... 101/416.1
6,413,580 B1 * 7/2002 Haas et al. ..... 101/424.2
6,482,468 B1 * 11/2002 Haas ..... 427/202

FOREIGN PATENT DOCUMENTS

| | | |
|---|---|---|
| CH | 327747 | 3/1954 |
| DE | 1 820 842 | 9/1960 |
| DE | 24 52 052 | 5/1976 |
| DE | 32 17 779 | 11/1983 |
| DE | 37 39 968 | 7/1987 |
| EP | 0 528 613 | 2/1993 |
| GB | 910 834 | 11/1962 |
| JP | 59 081175 | 5/1984 |
| JP | 2 76738 | 6/1990 |

* cited by examiner

*Primary Examiner*—Leslie J. Evanisko
*Assistant Examiner*—Kevin D. Williams
(74) *Attorney, Agent, or Firm*—Young & Basile, P.C.

(57) ABSTRACT

A method and device for powdering the printed sheets of paper. Powder is periodically introduced into the airflow by a dosing element.

12 Claims, 2 Drawing Sheets

DEVICE FOR POWDERING PRINTING SHEETS

BACKGROUND

The invention pertains to a method for powdering printed sheets, wherein the sheets are printed on one or both sides in a printing machine and powder is taken out of a supply container by means of a metering element and blown onto the sheets by means of an air current, and powder is always carried in the air current and ejected when a sheet is present. The invention also pertains to a device for powdering printing sheets, which contains a supply container for the powder and a metering element that is connected in series with the supply container and opens up into an air current that ejects the powder.

It is common practice to dust printed paper sheets with powder before stacking so that the still wet printing ink is not smeared. The sheets are usually dusted by a powdering device, in which powder is mixed with an air current and the powder is ejected in the air current and applied onto the sheet. The dusting devices usually contain a supply container that fills a powder container with powder. An air current is blown into this powder container such that the powder is whirled up and ejected with the emerging air. This air is subsequently blown onto the sheet. In dusting devices of this type, it has been determined that the quantity of the ejected powder highly depends on the quantity of powder situated in the powder container as well as the flow speed of the air current. It has also been determined that the type of powder represents a significant factor in this respect. A pulsed air current may also cause problems if the dusting frequency reaches the resonant range of the air current.

Consequently, the invention is based on the objective of providing a method and/or a device that can dust printing sheets in a more precise and significantly easier fashion while ensuring reduced powder loss.

SUMMARY

According to this inventive method, powder is always introduced into the air current when a sheet surface to be dusted is present by timing the metering process such that it is coordinated with the presence of the sheet.

This means that an air current is always present, and that powder is always introduced into this permanent air current when there is a sheet surface to be dusted. In comparison with the state of the art, the method according to the invention provides the significant advantage that the admixing of powder is timed instead of the air current. Consequently, resonance that could negatively influence the transport of the powder or the printed paper web cannot form in the air current.

Since the powdering device is not situated directly at the outlet of the air current, i.e., it is situated at a distance from the paper web, the powder is added in a metered fashion at a certain advance time, with this advance time being synchronized with the flow speed of the air current and the length of the air conduits. The powder is ejected precisely when a printed paper sheet is situated underneath the blow nozzles. Air that does not contain any powder is ejected if no paper sheet is situated underneath the blow nozzles.

According to one additional development of the invention, the air current blows through the metering element, i.e., the powder is removed from the metering element by the air current. The advantages of this method can be seen in the fact that the powder is already mixed with air and that the method can be carried out without creating any wear.

The objective of the invention mentioned above is attained with a device that can drive the metering element in a cyclical fashion, with the timing corresponding to the presence of a sheet to be powdered. This metering element always admixes powder with the air current when a printed sheet needs to be dusted. This provides the significant advantage that, as mentioned previously, a permanent air current is present and a pulsating or oscillating air column can be prevented. Powder is only introduced into this air current when necessary, i.e., when a sheet is transported past the dusting device.

In the embodiments of the invention, the metering element contains a rotationally symmetrical body, e.g., a cone, a ball, a roller, in particular, with a horizontally driven rotational axis or a metering band. These transport devices transport the powder from the supply container into the air current, with the transport elements being driven in a cyclical fashion.

In one embodiment, in which the metering element is realized in the form of a roller, the roller has an uneven surface viewed in the transport direction containing grooves that extend in the circumferential direction and are arranged on the periphery of the roller. These grooves provide the significant advantage that the surface of the roller receiving the powder is significantly increased, whereby the adhesive forces that hold the powder on the roller are substantially higher than in metering elements with a smooth surface. The powder actually adheres to the grooved roller so well that it does not fall out of the grooves due to gravity.

A roller that is provided with cells on its surface is known from U.S. Pat. No. 4,867,063. Although this cell conveyor also makes it possible to easily transport pourable material, the cells gradually become clogged when powder is transported, so that the volume being transported decreases over time. This means that a constant volume transport over an extended period of time cannot be ensured with cell conveyors of this type.

According to an additional configuration of the invention, the metering element is provided with a device for removing the powder from the metering element. This device consists of a blade, a brush, a blow nozzle or the like. Devices of this type are able to project into the circumferentially extending grooves of the roller relatively easily and remove the powder in this fashion. This is not possible with cell conveyors because, for example, a blade is unable to project into individual cells.

According to a refinement, the metering element has a powder-friendly surface.

In another embodiment, the metering element is realized in the form of a circular disk with concentric rings, and the opening of the supply container is located in one section such that powder is transported away from the region of this opening by the concentric rings. The powder is subsequently lifted out of the concentric rings by a blade. The powder could also be blown out of the rings with a suitable device containing blow nozzles.

The cyclical operation of the metering element is achieved by using a step motor as the drive. This step motor has a variable rotational speed and frequency and is controlled by the transport device (sheet feeder) for the printed paper sheets. A change in the driving speed of the step motor causes a change in the volume flow, and the metering element can be adapted to the size and speed of the paper sheets by varying the cycle frequency.

In order to prevent the powder from flowing out of the supply container, the metering element contains an outlet opening that is offset relative to the inlet opening by more than 180° in the rotating direction. Due to this measure, the powder is prevented from flowing directly from the inlet opening to the outlet opening through the grooves in the roller of the metering element and is admixed with the air current in an uncontrolled fashion.

BRIEF DESCRIPTION OF THE DRAWING

Additional advantages, characteristics and details of the invention are disclosed in the following description, in which one particularly preferred embodiment is described in greater detail with reference to the figures. The characteristics that are illustrated in the figures and disclosed in the description and in the claims may be essential to the invention individually or in arbitrary combinations. Shown in the drawing are:

DETAILED DESCRIPTION

Figure 1:
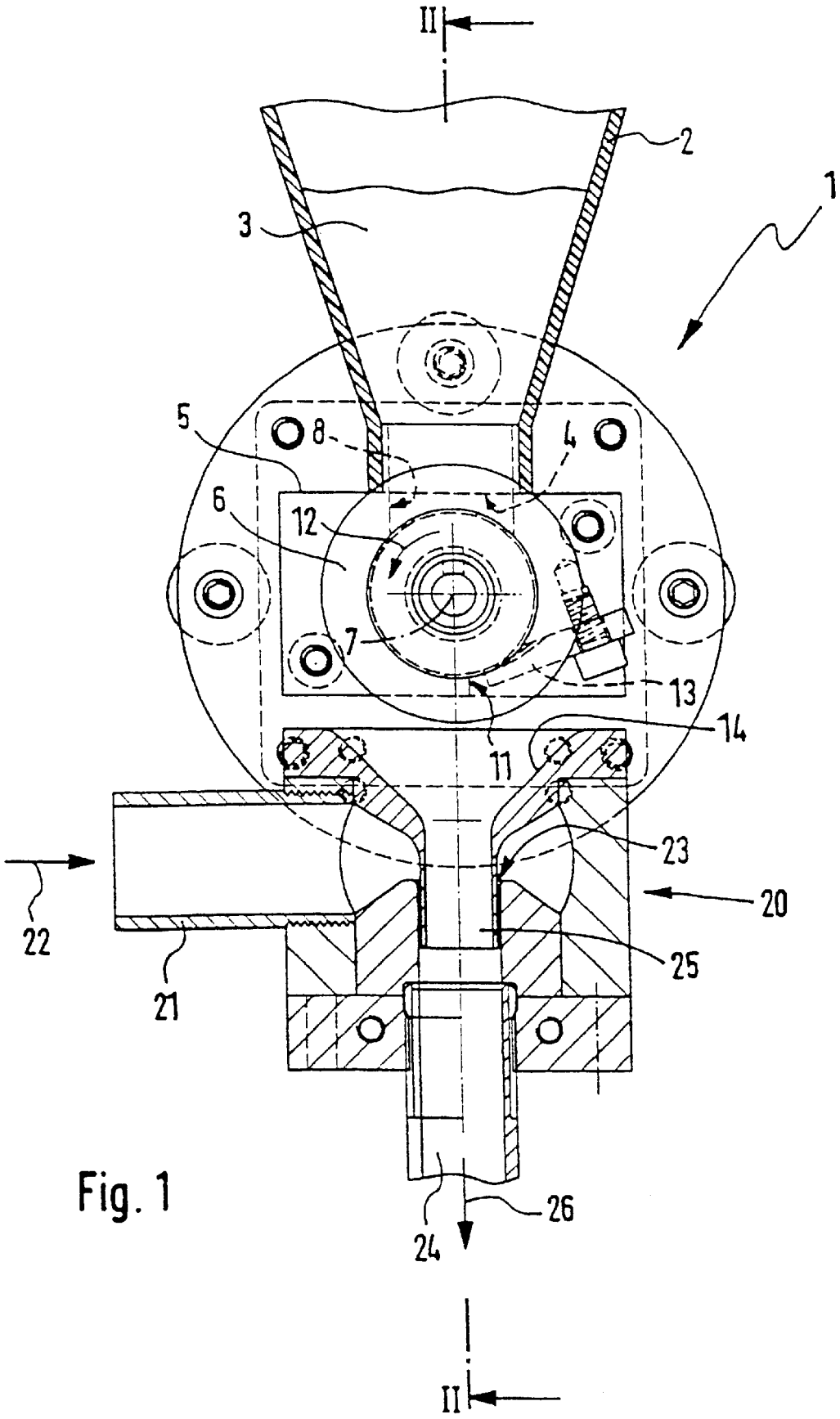
FIG. 1 is a longitudinal section through a metering element of a dusting device.

In FIG. 1, the reference number 1 identifies a metering element that contains a funnel which serves as the supply container 2 for the powder 3. The supply container 2 has an outlet opening 4 that rests on a roller housing 5. A metering roller 6 is arranged in this roller housing 5 such that it can rotate about a horizontal axle 7. This metering roller 6 essentially has a cylindrical shape and is arranged in a corresponding bore in the roller housing 5 with almost no play. The outlet opening 4 opens into an inlet opening 8 arranged within the upper region of the roller housing 5, with the powder 3 stored in the supply container 2 being introduced into the roller housing 5 through the inlet opening.

Figure 2:
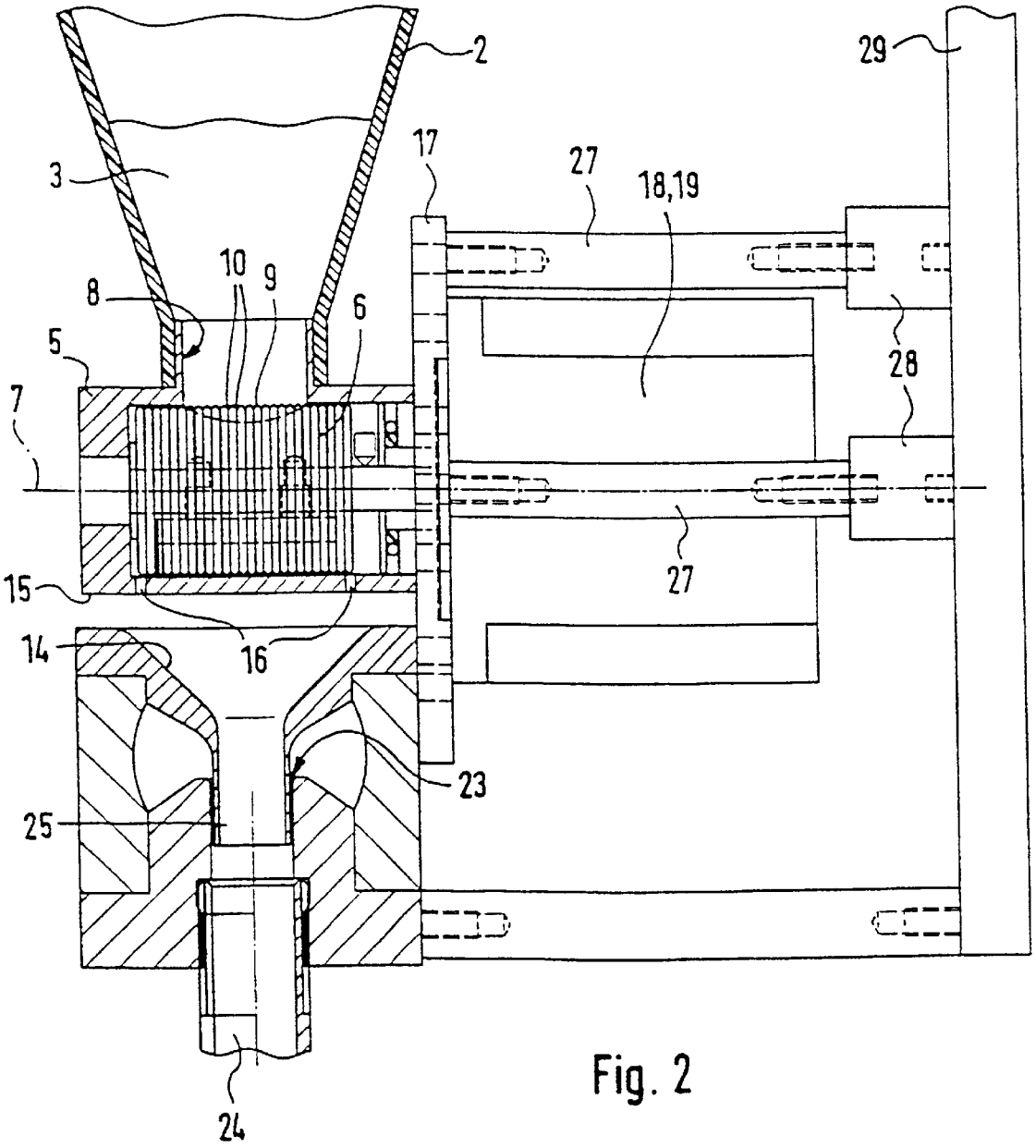
FIG. 2 is a section along the line II—II in FIG. 1.

FIG. 2 shows that the inlet opening 8 ends directly above the surface 9 of the roller 6. The surface 9 of the metering roller 6 is provided with a series of grooves 10 that extend in the circumferential direction, with the grooves 10 extending beyond the inlet opening 8 on both sides of the metering roller 6. Powder is no longer introduced into the grooves 10 within these regions such that the grooves act as a labyrinth seal at these locations. The powder is transported in the direction of an outlet opening 11 by means of the grooves 10 that are filled with powder. However, the outlet opening 11 does not lie directly underneath the inlet opening 8, but is offset by more than 180° relative to the inlet opening 8 (FIG. 1) in the rotating direction (arrow 12). A blade 13 that projects into the grooves 10 of the metering roller 6 is also arranged in this outlet opening 11. This blade 13 lifts the powder 3 out of the grooves 10 such that the powder can be removed from the roller housing 5 and placed into a collection funnel 14 through the outlet opening 11. The blade 13 ensures that the grooves 10 are completely emptied and that the grooves 10 are once again available for receiving powder 3 at the inlet opening 8.

FIG. 2 also shows that two bores 16 are provided on the underside 15 of the roller housing 5 within the region of the end faces of the metering roller 6. Powder that migrates into the labyrinth seals can be removed and transported into the collection funnel 14 through these two bores such that this powder is unable to reach the bearings for the axle 7. FIG. 2 also shows that the metering roller 6 is cantilevered, with a step motor 19 that serves as the drive 18 being situated on one side of a holding bracket 17, and with the roller housing 5 and the metering roller 6 attached to the shaft of the step motor 19 being situated on the other side of the holding bracket 17. The cantilevered arrangement of the metering roller 6 allows a rapid and uncomplicated exchange for maintenance and/or repair purposes. The holding bracket 17 is mounted on a frame 29 by means of bolts 27 and rubber buffers 28.

The volume being transported is adjusted by varying the step motor 19, in particular, its rotational speed. The cycle time is adapted to the speed or the cycle time of the paper sheets by varying the frequency of the step motor 19.

As mentioned previously, the powder being transported by the metering roller 6 drops into the collection funnel 14 which opens up into an injector device 20. This injector device is provided with a connection 21, through which air is introduced in the direction of arrow 22. This air is introduced into a mixing channel 24 through a nozzle 23. During this process, a negative pressure is generated in the funnel neck 25, with this negative pressure attracting the powder from the collection funnel 14 and transporting the powder in the direction of the mixing channel 24 where it is mixed with the air current and additionally transported into a suitable distribution system in the direction of arrow 26. Since a negative pressure is generated within the entire region of the collection funnel 14, powder cannot escape from the metering element, which means that contamination of the sheet feeder and, in particular, the printing machine is prevented.

What is claimed is:

1. A device for carrying out powdering printing sheets, with a supply container for the powder and a metering element that is connected in series with the supply container the metering element opening up into a mixing area where an air current ejects the powder, the metering element being driven in a cyclical fashion so that a timing of powder being introduced into the mixing area corresponds to the presence of a printing sheet, the metering element containing a rotationally symmetrical body with a horizontally arranged rotational axle, a step motor being provided as the drive for thy metering element, further comprising the metering element being cantilevered; and a cantilevered roller housing defining a bore, the metering element arranged in the bore.

2. The device of claim 1 wherein the supply container rests on the roller housing.

3. The device of claim 1 wherein the roller housing further comprises:

a plurality of openings in communication with the air current.

4. The device according to claim 1, characterized by the fact that the metering element is provided with a device for removing the powder from the metering element.

5. The device according to claim 4, characterized by the fact that the device consists of one of a blade, a brush, and a blow nozzle.

6. The device according to claim 1, characterized by the fact that the metering element has a powder-friendly surface.

7. The device of claim 1 further comprising:

a collection funnel disposed under the metering element and the blade to receive powder lifted out of the at least one groove.

8. The device of claim 1 wherein the at least one circumferential groove further comprises:

a plurality of circumferential grooves disposed along a length of the metering element.

9. The device of claim 8 wherein the supply container includes an inlet opening for communicating powder to the metering element and the length of the metering element extends beyond the opening in at least one direction.

10. A device for carrying out powdering printing sheets, with a supply container for the powder and a metering element that is connected in series with the supply container the metering element opening up into a mixing area where an air current ejects the powder, the metering element being driven in a cyclical fashion so that a timing of powder being introduced into the mixing area corresponds to the presence of a printing sheet, the metering element containing a rotationally symmetrical body with a horizontally arranged rotational axle, a step motor being provided as the drive for the metering element, further comprising the metering element being cantilevered, the metering element being arranged in a corresponding bore of a roller housing, the roller housing containing an outlet opening that is offset relative to an inlet opening by more than 180° and less than 270° viewed in a rotating direction, and the roller housing being cantilevered and supporting supply container.

11. The device of claim 10 further comprising:

a mixing channel in communication with the outlet opening and offset relative to the inlet opening by 180° viewed in the rotating direction.

12. The device of claim 10 wherein the metering element is selected from the group consisting of a cylinder, a cone and a ball.

* * * * *